US008584293B1

(12) United States Patent
Arnal et al.

(10) Patent No.: US 8,584,293 B1
(45) Date of Patent: Nov. 19, 2013

(54) FOOTWEAR CLEANING DEVICE FOR REMOVING MAGNETIC AND NON-MAGNETIC CONTAMINANTS

(75) Inventors: David B. Arnal, Mount Laurel, NJ (US); Timothy T. Broderick, Voorhees, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 988 days.

(21) Appl. No.: 12/173,364

(22) Filed: Jul. 15, 2008

(51) Int. Cl.
*A47L 23/22* (2006.01)

(52) U.S. Cl.
USPC ..... 15/36; 15/112

(58) Field of Classification Search
USPC ..... 15/30, 34, 36, 265, 161, 215–217, 15/237–241, 105, 97.2, 4, 21.1, 97.1; 209/215, 223.2, 223.1; 451/912; 198/619
See application file for complete search history.

(56) References Cited

U.S. PATENT DOCUMENTS

| | | | | | |
|---|---|---|---|---|---|
| 703,329 | A | * | 6/1902 | Winder | 209/223.1 |
| 846,020 | A | * | 3/1907 | Feld | 15/36 |
| 1,019,672 | A | * | 3/1912 | Lineback | 15/34 |
| 1,277,834 | A | * | 9/1918 | Berdar | 15/36 |
| 1,952,222 | A | * | 3/1934 | Rostoker | 15/36 |
| 2,436,315 | A | * | 2/1948 | Liberatore | 15/112 |
| 2,463,153 | A | * | 3/1949 | Conklin | 15/36 |
| 2,709,002 | A | * | 5/1955 | Hoff | 209/215 |
| 2,733,812 | A | * | 2/1956 | Hoff | 209/223.1 |
| 2,858,021 | A | * | 10/1958 | Baermann | 209/215 |
| 2,895,159 | A | * | 7/1959 | Ostrow | 15/311 |
| 2,919,803 | A | * | 1/1960 | Stem | 209/223.1 |
| 2,992,735 | A | * | 7/1961 | Troy | 209/223.1 |
| 3,160,583 | A | * | 12/1964 | Stem | 209/223.1 |
| 3,343,675 | A | * | 9/1967 | Budd | 209/215 |
| 3,468,406 | A | * | 9/1969 | Spodig | 198/619 |
| 3,557,928 | A | * | 1/1971 | Cromwell et al. | 194/241 |
| 3,729,761 | A | * | 5/1973 | Lashley | 15/31 |
| 3,802,021 | A | * | 4/1974 | Schulz | 15/36 |
| 3,831,217 | A | * | 8/1974 | Odawara | 15/34 |
| 3,952,857 | A | * | 4/1976 | Nazuka | 198/637 |
| 4,118,818 | A | * | 10/1978 | Holleran | 15/36 |
| 4,156,298 | A | * | 5/1979 | Spence | 15/142 |
| 4,234,076 | A | * | 11/1980 | Spodig | 198/690.1 |

(Continued)

FOREIGN PATENT DOCUMENTS

| | | | | |
|---|---|---|---|---|
| JP | 51143275 | A | * | 12/1976 |
| JP | 56084650 | A | * | 7/1981 |
| JP | 2005350171 | A | * | 12/2005 |
| RU | 1835304 | A1 | * | 8/1993 |

OTHER PUBLICATIONS

"Magnet." Def. 1. Merriam Webster Online, Merriam Webster, n.d. Web. Feb. 26, 2013.*

*Primary Examiner* — Lee D Wilson
*Assistant Examiner* — Joel Crandall
(74) *Attorney, Agent, or Firm* — Howard IP Law Group, PC

(57) ABSTRACT

A device for removing metallic and other contaminant particles accumulated on footwear, comprises in one embodiment, a housing and a grid of cleaning rods supported by the housing. The grid of cleaning rods typically includes rotating rods and non-rotating rods which vibrate. Some of the rotating rods are provided with brushing elements and some of the rotating rods are provided with magnetic elements or are magnetic. The rotating rods with the magnetic elements or which are magnetic, remove the metallic contaminant particles from the footwear.

17 Claims, 5 Drawing Sheets

(56) References Cited

U.S. PATENT DOCUMENTS

| | | | | | |
|---|---|---|---|---|---|
| 4,313,238 | A * | 2/1982 | Harbin | 15/37 |
| 4,482,244 | A * | 11/1984 | Yamazaki et al. | 399/356 |
| 4,922,578 | A * | 5/1990 | Miettinen | 15/36 |
| 5,025,528 | A * | 6/1991 | Burey et al. | 15/302 |
| 5,316,151 | A * | 5/1994 | Thompson | 209/223.1 |
| 5,481,983 | A | 1/1996 | Guzman et al. | |
| 5,979,957 | A * | 11/1999 | Conrad et al. | 294/65.5 |
| 6,393,657 | B1 * | 5/2002 | Zimet | 15/339 |
| 6,813,795 | B2 * | 11/2004 | Graves | 15/36 |
| 8,161,590 | B2 * | 4/2012 | Feeg et al. | 15/34 |
| 2002/0029432 | A1 | 3/2002 | Graves et al. | |
| 2004/0019988 | A1 | 2/2004 | Graves | |
| 2005/0115010 | A1 | 6/2005 | Jackson | |
| 2006/0117598 | A1 * | 6/2006 | Czaplewski et al. | 36/2 R |
| 2008/0256728 | A1 * | 10/2008 | Feeg et al. | 15/34 |
| 2009/0199867 | A1 * | 8/2009 | Woods | 134/6 |

* cited by examiner

FOOTWEAR CLEANING DEVICE FOR REMOVING MAGNETIC AND NON-MAGNETIC CONTAMINANTS

GOVERNMENTAL INTEREST

This invention was made with Government support under Contract No, N00024-03-C-5115 awarded by the Department of the Navy. The Government has certain rights in this invention.

FIELD OF THE INVENTION

The present invention relates to footwear cleaning devices, and, more particularly, to a footwear cleaning device for removing magnetic and non-magnetic contaminants.

BACKGROUND OF THE INVENTION

Abrasives, grindings, metal chips and other contaminant particles are common during the construction of ships. Such contaminant particles, when accumulated on the ship, can damage the ship's equipment.

These contaminant particles are transferred to all areas of the ship by foot traffic. Cleaning the contaminant particles admitted to an area sensitive thereto is time consuming and costly. If the footwear is cleaned prior to entering the area, clean-up requirements are reduced.

A common solution for preventing contamination transfer to these areas is a footwear cleaning mat. Such mats, however, do not effectively remove the contaminant particles, particularly metallic particles, from the footwear and the removed contaminant particles are not effectively transported away from the cleaning surfaces of the mat.

Accordingly, a device is needed for removing metallic, non-metallic, and other contaminant particles from footwear.

SUMMARY

A device for removing metallic and other contaminant particles accumulated on footwear, comprises in one embodiment, a housing and a grid of cleaning rods supported by the housing. The grid of cleaning rods includes at least one rod capable of generating a magnetic field which removes the metallic contaminant particles from the footwear.

In another embodiment, the device further comprises a first motor for rotating the at least one rod capable of generating a magnetic field rotates a selected speed.

In still another embodiment, the grid of cleaning rods further includes at least one rod with brushing elements.

In yet another embodiment, the at least one rod with brushing elements is rotated by the first motor or by a second motor.

In a further embodiment, the grid of cleaning rods further includes at least one vibrating rod.

In still a further embodiment, the device further comprises a vibrating motor for vibrating the at least one vibrating rod.

In yet still a further embodiment, the device further comprises a receptacle disposed below the grid of cleaning rods, for collecting the contaminant particles removed from the footwear by one or more of the rods.

In another embodiment, the at least one rod capable of generating a magnetic field is magnetic.

In an alternate embodiment, the at least one rod capable of generating a magnetic field includes one or more magnetic elements.

DETAILED DESCRIPTION OF THE INVENTION

Figure 1:
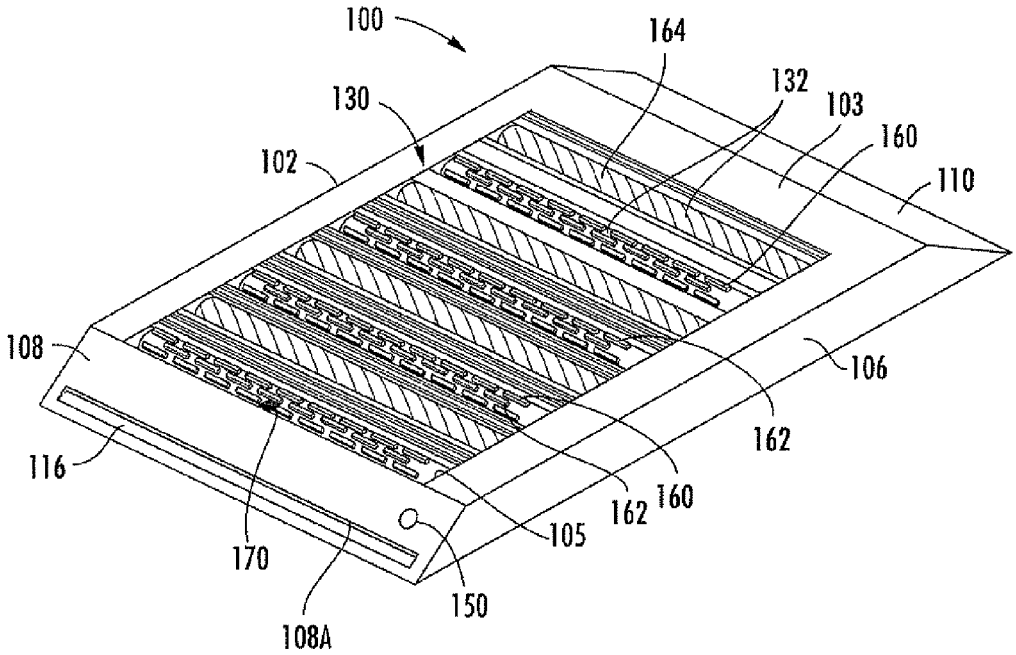
FIG. 1 is a perspective view of a first embodiment of a footwear cleaning device.
Figure 2:
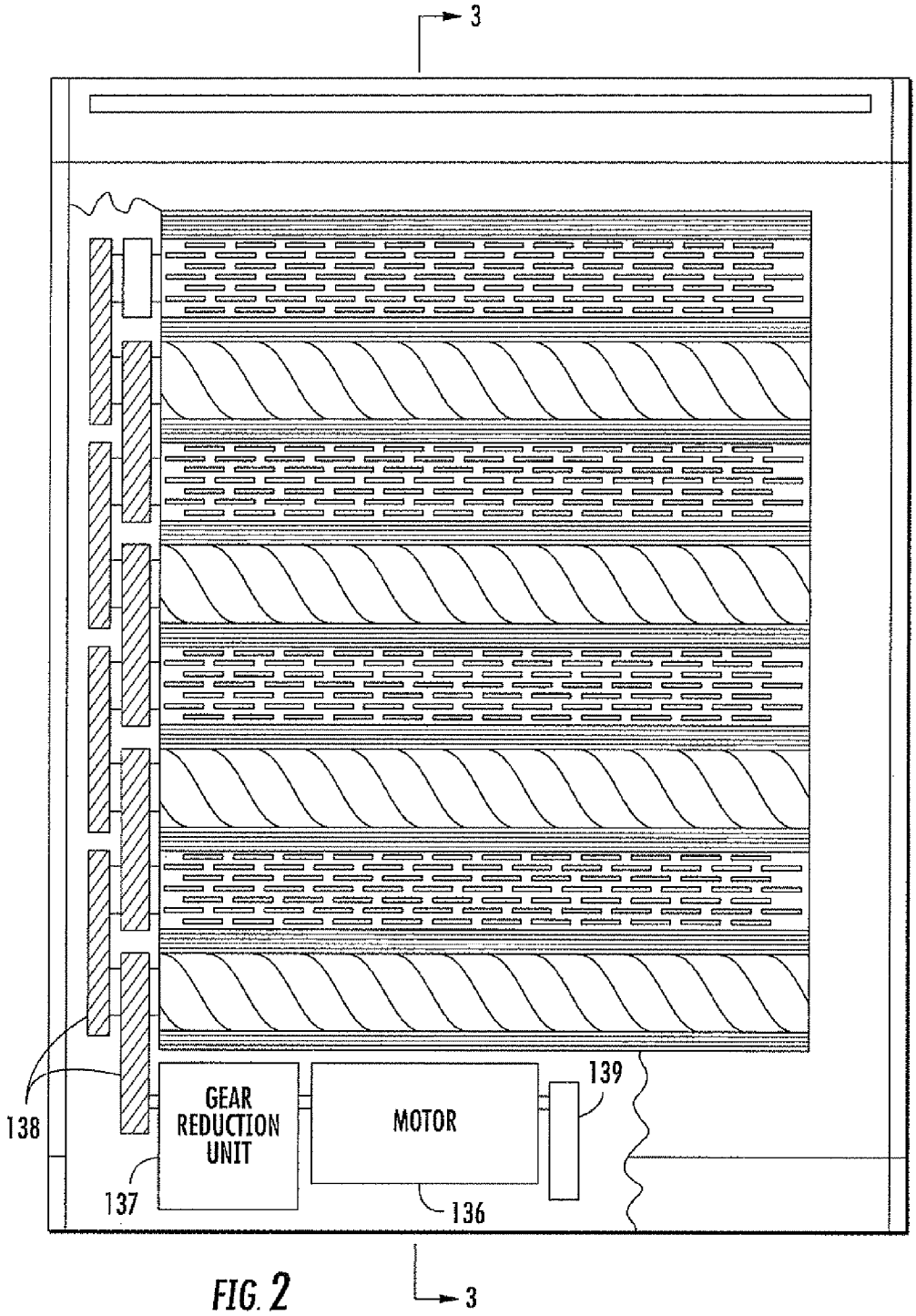
FIG. 2 is a top plan view of the footwear cleaning device of FIG. 1.

FIGS. 1-5 collectively show a first embodiment of a footwear cleaning device, denoted generally by reference character 100. The footwear cleaning device 100 comprises a main housing 102 formed by a top wall 103, opposing first and second vertical side walls 104, 106, a first slanted end wall 108 connecting first ends of the vertical side walls 104, 106 and a second slanted end wall 110 disposed opposite to the first slanted end wall 108 connecting second ends of the vertical side walls 104, 106. The vertical side walls 104, 106 define bottom edge surfaces 104*b*, 106*b* for supporting the device on a support surface. A first horizontal flange 112 (FIG. 5) is disposed on an inner surface 104*a* of the first side wall 104 adjacent to the bottom edge surface 104*b* thereof and a second horizontal flange 114 is disposed on an inner surface 106*a* of the second side wall 106 adjacent to the bottom edge surface 106*b* thereof. A removable drawer 116 (FIGS. 14, and 5), which forms the bottom of the main housing 102, is slidably disposed on upper surfaces of the flanges 112, 114. The drawer 116 (FIG. 4) is formed by a horizontal base wall 118 and first and second opposing vertical side walls 120, 122 and first and second opposing vertical end walls 124, 126, extending up from a top surface of the base wall 118 along a perimeter of the base wall. As shown in FIG. 1, the first slanted end wall 108 of the main housing 102 extends partially down from the top of the main housing 102 thereby defining an opening 108*a* through which the drawer 116 passes so that the drawer 116 can be removed from and then reinstalled in the main housing 102.

The main housing 102 may be made from any suitable material including but not limited to metals and plastics, which is capable of securely supporting adults of various weights.

Referring again to FIG. 1, an opening 105 is provided in the top wall 103 of the main housing 102. Disposed within the opening 105 of the main housing 102, above the drawer 116, is a grid of cleaning rods 130. The grid of cleaning rods 130 extend between the vertical side walls 104,106 of the main housing 102. A fixed tread 131 is disposed between each pair of cleaning rods 130 and next to the cleaning rods 130 at each end of the grid. The fixed treads 131 extend between the vertical side walls 104,106 of the main housing 102, parallel with the cleaning rods 130. The grid of cleaning rods 130 includes rotating rods 132. Alternatively in a second embodiment shown in FIG. 6, where like elements are identified by like reference characters, the device 100' has a grid of cleaning rods 130 that includes rotating rods 132 and non-rotating rods 134.

Figure 3:
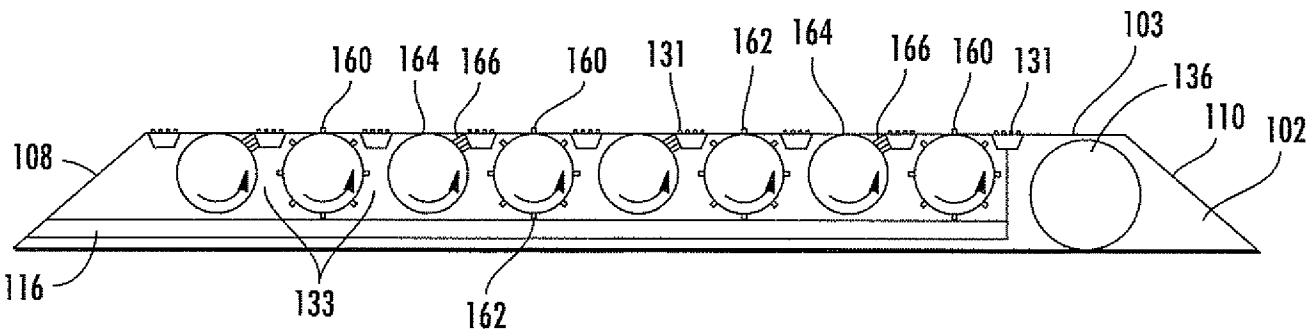
FIG. 3 is a cross-sectional view through line 3-3 of the footwear cleaning device of FIG. 1.
Figure 4:
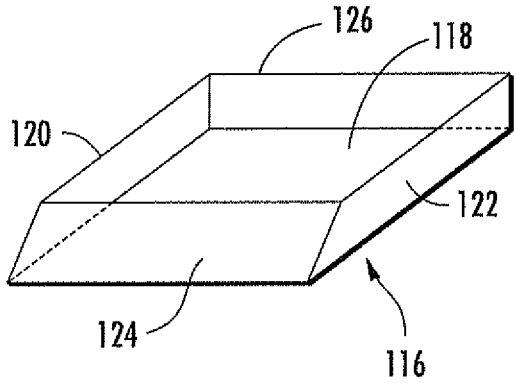
FIG. 4 is a perspective view of a removal drawer of the cleaning device of FIG. 1.
Figure 5:
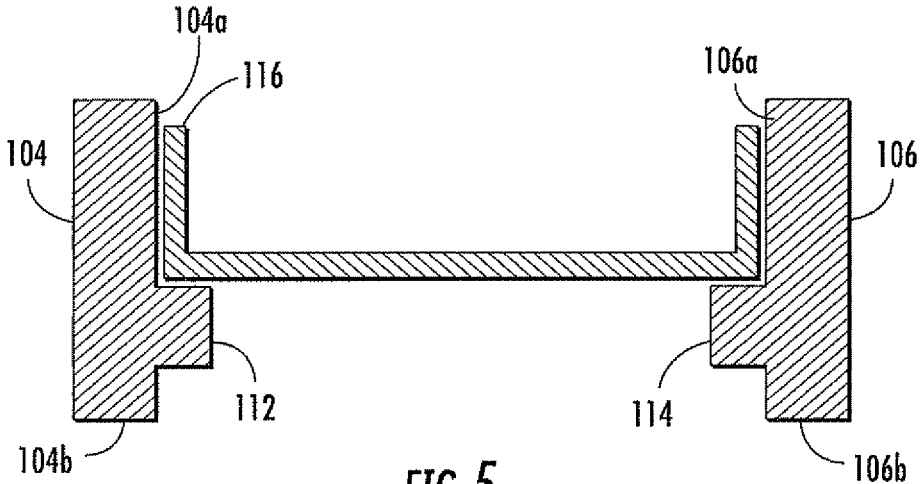
FIG. 5 is a section view through the footwear cleaning device of FIG. 1.

Referring to FIG. 3, a gap 133 is provided between each pair of rods 130 in the grid, below the fixed tread 131, to allow the contaminant particles removed by the rods 130 to fall through the grid and onto the base wall of the drawer 116. To ensure that the contaminant particles fall through the gaps 133 in the grid and do not remain on the rotating rods 132, the fixed rods 131 are each provided with brushing elements 166 that brush the contaminants off the rotating rods 132 as they rotate.

The rotating rods 132 rotate in bearing or bushing elements (not shown) that are disposed in the vertical side walls 104, 106 of the main housing 102. In the second embodiment of FIG. 6, the rotating rods 132 and non-rotating rods 134 may be alternately disposed within the grid 130. In another embodiment, pairs of rotating rods and pairs of non-rotating rods may be alternately disposed within the grid.

In one embodiment, the cleaning rods 130 may have a round cross-sectional shape. Cleaning rods 130 having other suitable cross-sectional shapes or a mix of shapes may also be used. The cleaning rods 130 may be made from any suitable material including but not limited to metals and plastics, which is capable of securely supporting adults of various weights.

Some of the rotating rods 132 include brushing elements 160 and some of the rotating rods 132 include magnetic elements 162. In alternate embodiments, the rotating rods 132 may include both brushing elements 160 and magnetic elements 162. In other embodiments, the rotating rods 132 may be magnetic rotating rods 164, and therefore, do not include magnetic elements. In the first embodiment of FIGS. 1-5, some of the rotating rods 132 include brushing elements 160, some of the rotating rods 132 include magnetic elements 162, some of the rotating rods 132 include both brushing elements 160 and magnetic elements 162, and some of the rotating rods 132 are magnetic rotating rods 164.

The rotating rods 132 with the brushing elements 160 brush contaminant particles off the footwear. The magnetic rotating rods 132 or the rotating rods 132 with the magnetic elements 160, magnetically attract and remove metallic contaminant particles from the footwear.

In the first embodiment, the rotating rods 132 are rotated by a single electric motor 136 at a selected speed via a gear reduction unit 137 and an arrangement of belts and pulleys 138. In other embodiments, a gear drive and/or chain-spocket arrangement may be used in place of or in combination a belt and pulley arrangement. A weight 139 is eccentrically mounted to the electric motor 136 for causing the rotating rods 132 to vibrate at a selected frequency and amplitude.

In the second embodiment, each rotating rod 132 is rotated at a selected speed by a corresponding electric motor 140. The frequency and amplitude of vibration is selected to loosen contaminant particles stuck to the footwear so that the particles may fall through the gaps 133 between the rotating rods 132, and/or be brushed off the footwear by the rotating rods 132 with the brushing elements 160, and/or fall off and attach to the magnetic rotating rods 164 or the magnetic elements 162 of the rotating rods 132.

Figure 6:
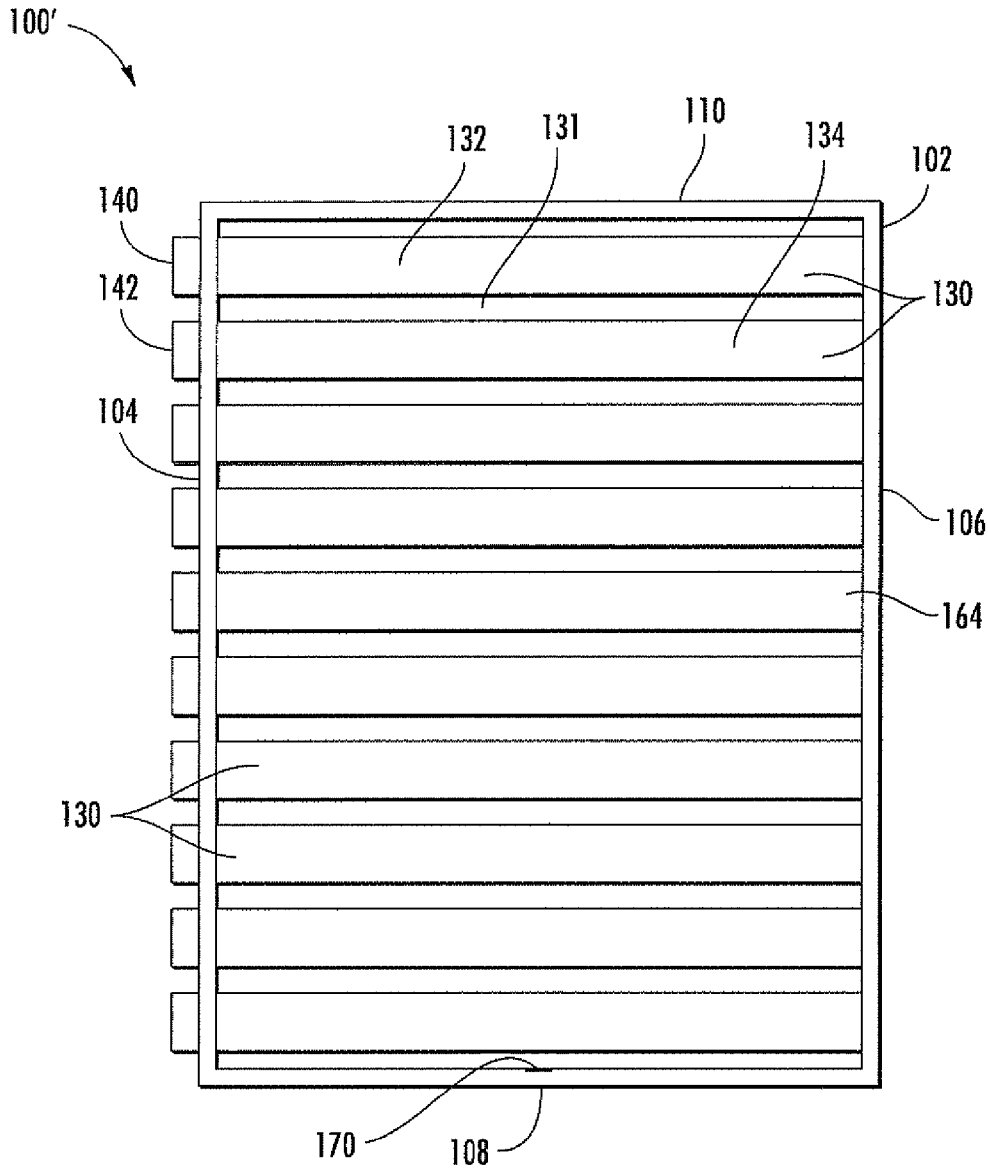
FIG. 6 is a top plan view of a second embodiment of a footwear cleaning device.

Referring again to the device of FIG. 6, each non-rotating rod 134 may be connected to a vibratory electric motor 142 which causes the non-rotating rod 134 to vibrate at a selected frequency and amplitude. Alternatively, the non-rotating rods 134 may be connected to a single vibratory electric motor 142 via a gear drive, belt, and/or chain arrangement (not shown), which causes all the non-rotating rods 134 to vibrate at a selected frequency and amplitude. The frequency and amplitude of vibration is selected to loosen contaminant particles stuck to the footwear so that the particles may fall through the gaps 133 between the cleaning rods 130, and/or be brushed off the footwear by the rotating rods 132 with the brushing elements, and/or fall off attach to the magnetic rotating rods 164.

In one exemplary embodiment, a foot or hand actuated on/off switch 150 for activating the motors 136,140, 142 of the footwear cleaning device 100, 100' is conveniently disposed on the outer surface of the main housing 102. In an alternative exemplary embodiment, a sensor for sensing the placement of a user's foot or feet on the grid of cleaning rods 130 is provided for automatically activating and deactivating the motors 136,140, 142 of the device 100, 100'. The sensor 170 may be an electronic eye disposed on (as shown) or otherwise operatively associated with the footwear cleaning device 100, 100', or a weight sensor operatively associated with the device 100,100'.

In operation, a user places one or both feet on the grid of cleaning rods 130. The vibrating rods loosen contaminant particles stuck to the footwear so that the particles fall through the gaps 133 between the cleaning rods 130. Any particles that remain attached to the footwear are brushed off the footwear by the brushing elements of the rotating rods 132 and directed toward the gaps 133. Metallic contaminant particles attached to the footwear may be removed by the magnetic field generated by the rotating magnetic rods 132 or the rotating rods with the magnetic elements 162.

The drawer 116 collects any contaminant particles that falls through the gaps between the rods 130 during footwear cleaning. The drawer 116 may be emptied by removing the drawer 116 from the main housing 102 of the device and emptying the drawer 116. The drawer 116 may then be reinstalled into the main housing 102.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments it is not limited thereto. Rather, the appended claims should be construed broadly, to include other variants and embodiments of the invention, which may be made by those skilled in the art without departing from the scope and range of equivalents of the invention.

What is claimed is:

1. A device for removing metallic and other contaminant particles accumulated on footwear, the device comprising:

a housing comprising a first support and a second support, and a grid of cleaning rods, each of the rods having a first end and a second end supported by the first support and the second support, respectively, wherein the grid of cleaning rods includes at least one rod having at least one magnetic element fixedly attached to an outer surface thereof for removing metallic contaminant particles from the footwear, wherein the grid of cleaning rods further comprises at least one rod with brushing elements for brushing off the contaminant particles from the footwear, and wherein the magnetic element comprises an elongated profile oriented axially with respect to the at least one rod.

2. A device for removing metallic and other contaminant particles accumulated on footwear, the device comprising:

a housing comprising a first support and a second support, and a grid of cleaning rods, each of the rods defining a longitudinal axis and having a first end and a second end supported by the first support and the second support, respectively, wherein the grid of cleaning rods includes:

at least one rod-shaped magnet capable of generating a magnetic field for removing metallic contaminant particles from the footwear, at least one rod rotatably supported about its longitudinal axis by the first and second supports, and at least one rod fixedly supported about its longitudinal axis by the first and second supports and, wherein the grid of cleaning rods further comprises at least one vibrating rod operatively connected to a vibrating motor for vibrating the at least one rod at a selected frequency and amplitude, the at least one vibrating rod fixedly supported about its longitudinal axis by the first and second supports.

3. The device of claim 2, wherein the grid of cleaning rods further comprises at least one rod with brushing elements for brushing off the contaminant particles from the footwear.

4. The device of claim 3, wherein the at least one rod-shaped magnet comprises brushing elements.

5. The device of claim 2, further comprising at least one tread element arranged between the first and second supports.

6. The device of claim 5, wherein the at least one tread element is arranged between cleaning rods.

7. The device of claim 2, wherein a plurality of the rods of the grid of cleaning rods are rotatably supported by the first and second supports.

8. The device of claim 7, further comprising a plurality of drive motors for rotating a respective one of the plurality of rotatably supported rods.

9. The device of claim 2, further comprising a drive motor for rotating the at least one plurality of rotatably supported rod.

10. The device of claim 2, wherein the grid of cleaning rods further comprises a plurality of vibrating rods.

11. The device of claim 10, wherein at least one of the vibrating rods is rotatably supported by the first and second supports.

12. A device for removing metallic and other contaminant particles accumulated on footwear, the device comprising:

a housing comprising a first support and a second support, and a grid of cleaning rods, each of the rods having a first end and a second end supported by the first support and the second support, respectively, wherein the grid of cleaning rods includes at least one rod having at least one magnetic element of a material that produces a magnetic field, the material fixedly attached directly to an outer surface thereof for removing metallic contaminant particles from the footwear wherein the grid of cleaning rods further comprises at least one rod with brushing elements for brushing off the contaminant particles from the footwear, and wherein the magnetic element comprises an elongated profile oriented axially with respect to the at least one rod.

13. The device of claim 12, wherein the at least one magnetic element includes a plurality of magnetic elements.

14. The device of claim 12, wherein the at least one rod is rotatably supported by the first and second supports, and the at least one magnetic element is configured to rotate with the at least one rod.

15. A device for removing metallic and other contaminant particles accumulated on footwear, the device comprising:

a housing comprising a first support and a second support, and a grid of cleaning rods, each of the rods defining a longitudinal axis and having a first end and a second end supported by the first support and the second support, respectively, the grid of cleaning rods including:

at least one vibrating rod operatively connected to a vibrating motor for loosening or removing contaminant particles from the footwear, and at least one rotating rod capable of generating a magnetic field for removing metallic contaminant particles from the footwear, wherein the at least one vibrating rod is fixedly supported about its longitudinal axis by the first and second supports.

16. The device of claim 15, wherein the at least one vibrating rod comprises a plurality of vibrating rods.

17. The device of claim 16, wherein each of the plurality of vibrating rods is operatively connected to a respective vibrating motor.

* * * * *